United States Patent [19]

Anderson et al.

[11] Patent Number: 4,614,219

[45] Date of Patent: Sep. 30, 1986

[54] FOUNDRY CORE FOR CROSSHEAD PISTON HEAD MEMBER

[75] Inventors: John D. Anderson, Saginaw; James W. MacGregor, Ann Arbor, both of Mich.

[73] Assignee: General Motors Corporation, Detroit, Mich.

[21] Appl. No.: 725,063

[22] Filed: Apr. 19, 1985

[51] Int. Cl.[4] ..... B22C 9/10

[52] U.S. Cl. ..... 164/369; 164/340; 164/232

[58] Field of Search ..... 164/369, 340, 232

[56] References Cited

U.S. PATENT DOCUMENTS 1,769,455 7/1930 Pickering ..... 164/369

*Primary Examiner*—Kuang Y. Lin

*Attorney, Agent, or Firm*—Douglas D. Fekete

[57] ABSTRACT

A foundry core is disclosed for molding a cast blank machinable to produce a crosshead piston head member. The core shapes an exterior surface region of the blank section corresponding to the ring belt in the machined product. The core-shaped exterior surface provides a readily accessible reference for accurately positioning the core during subsequent machining operations.

3 Claims, 6 Drawing Figures

FOUNDRY CORE FOR CROSSHEAD PISTON HEAD MEMBER

BACKGROUND OF THE INVENTION

This invention relates to the manufacture of a head member of a crosshead piston by casting and machining an iron blank. More particularly, this invention relates to a foundry core for molding an interior of the blank, which core also molds an exterior surface portion of the blank about a central axis so as to provide a reference for conveniently and precisely locating the axis for performing the machining operation.

A crosshead piston for a diesel engine comprises a head member pivotally connected to a separately formed skirt member. The head member comprises a combustion chamber-defining crown and a dependent annular ring belt that are symmetrical about a central longitudinal axis. In particular, it is desired that the inner wall and the outer wall of the ring belt lie concentric about the same axis. In addition, the head member comprises a skirt connection portion and a plurality of struts connecting the skirt connection portion to the ring belt and crown, which struts extend within the ring belt.

The head member is formed by casting an integral iron blank having sections corresponding roughly to the elements of the head member and machining exterior surfaces to finish the product. The blank is integrally cast in a foundry sand mold comprising a core for shaping the interior of the ring belt and the struts.

In order to precision machine the head, it is essential to determine the center axis in the blank. Despite the exercise of care in positioning the core within the foundry mold, the orientation of the core may vary. Heretofore, it has been necessary to locate upon an interior wall of the ring belt section of the blank in order to fix the center axis for the purpose of machining the exterior wall about the identical axis. Location upon the core-shaped interior ring belt wall in this manner permits the center axis to be determined relative to the interior wall, so that the finished exterior wall is machined concentric to the interior wall. However, access to the ring belt interior is cumbersome because of the presence of the struts and skirt connection portion.

Therefore, it is an object of this invention to provide a method for manufacturing a crosshead piston head member comprising casting an iron blank and machining the blank to produce the head member, which method provides an exterior, readily accessible blank surface that is precisely and reliably situated relative to the desired product axis for locating the blank for the machining operation.

More particularly, it is an object of this invention to provide a foundry core for incorporation into a foundry sand mold for casting a blank that is machinable to produce a crosshead piston head member, which core not only shapes an interior portion of the blank symmetrically about a central longitudinal axis, but also molds an exterior surface portion of the blank symmetrically about the axis. The core-molded exterior surface portion provides a readily accessible surface for determining the axis during subsequent machining operations.

SUMMARY OF THE INVENTION

In accordance with a preferred embodiment of this invention, these and other objects are accomplished by a foundry sand core for molding an interior structure of an iron blank machinable to produce a crosshead piston head member. The core metal-molding surfaces are radially symmetrical about a center axis. The core comprises an annular groove for shaping an annular open end extension of a blank section corresponding to the ring belt in the product head member. The groove is defined by inner and outer surfaces that respectively shape the interior and exterior surfaces of the ring belt extension. The groove surfaces are concentric about the central longitudinal axis. When the core is incorporated into a foundry mold and iron is cast therein, the groove outer surface shapes the exterior extension surface symmetrical about a center axis in the blank that is colinear to the core axis, despite variance in the position or orientation of the core with respect to other mold elements. As a result, the ring belt extension exterior surface provides a reliable locator for accurately determining the central axis in the blank during subsequent machining.

DESCRIPTION OF THE DRAWINGS

The present invention will be further illustrated with reference to the accompanying drawings wherein.

DETAILED DESCRIPTION OF THE INVENTION

Figure 1:
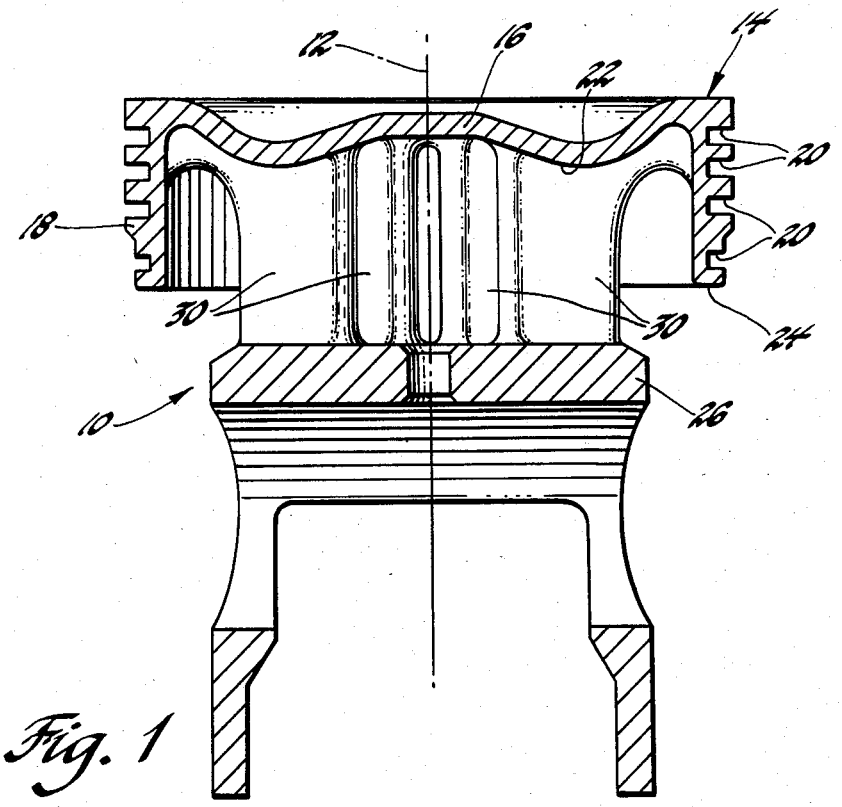
FIG. 1 is a cross-sectional view of an exemplary crosshead piston head member for manufacture in accordance with this invention.

In FIG. 1, there is depicted a crosshead piston head member 10 for manufacture in a preferred embodiment of this invention. Head member 10 is adapted for connection to a separately formed skirt member (not shown) to form a crosshead piston for a diesel engine. Piston member 10 has a central longitudinal axis 12 along which the piston reciprocates within the engine. Piston member 10 comprises a head portion 14 that includes a combustion chamber-defining crown 16 and an annular ring belt 18 peripherally dependent from crown 16. Crown 16 extends across an axial end of head member 10, generally perpendicular to and radially symmetrical about axis 12. Ring belt 18 is generally cylindrical about axis 12 and features a plurality of annular grooves 20 for receiving piston rings. Of significance to the present invention is that crown 16 and ring belt 18 cooperate to define a contoured interior wall 22 and that ring belt 18 is closed at one axial end by crown 16, but open at end 24 remote from crown 16.

Also, piston member 10 comprises a portion 26 for receiving a pin for connection to a separately formed skirt member. A series of struts 30 radially disposed about axis 12 within head portion 14 connect the head portion to the skirt connection portion 26.

Figure 2:
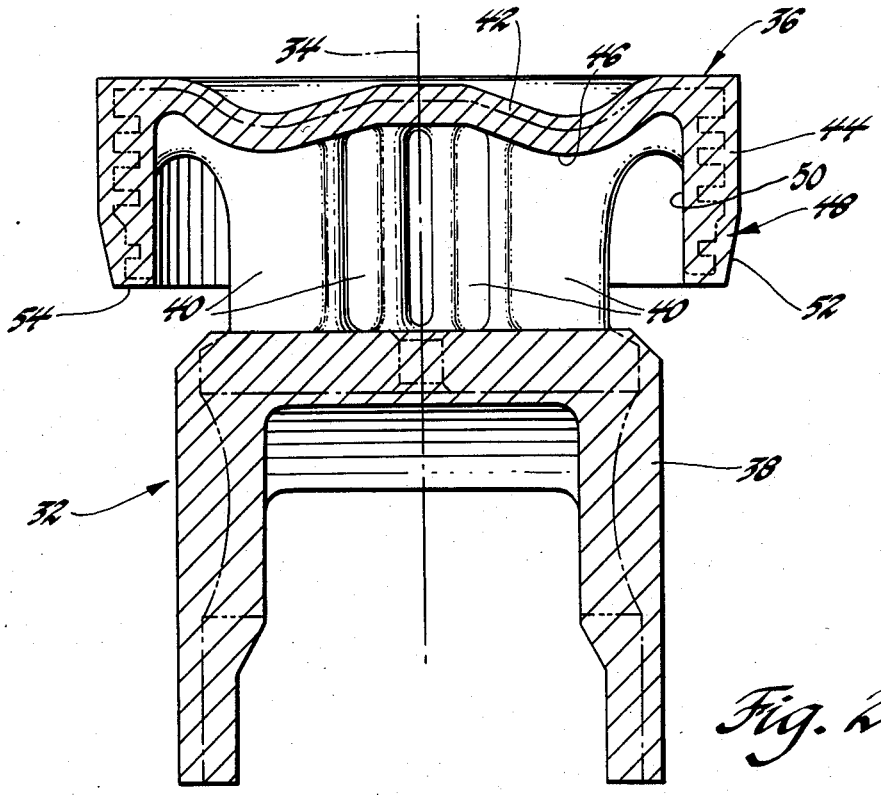
FIG. 2 is a cross-sectional view of cast iron blank machinable to produce the crosshead piston head member shown in FIG. 1.

FIG. 2 depicts a cast iron blank 32 machinable to produce head member 10 and having integrally cast sections roughly corresponding to the elements of product head member 10. As used herein, section shall refer to an as-cast portion of a blank that is machined to produce a corresponding element in a head member. Blank 32 has a central longitudinal axis 34 that is intended to correspond to axis 12 in product member 10. Blank 32 comprises a head section 36, an axially displaced skirt connection section 38, and a plurality of radially disposed struts 40 extending therebetween. Head section 36 comprises a crown subsection 42 and a peripherally dependent, annular ring belt subsection 44. For purposes of clarity, the machined contour of product member 10 is indicated by broken lines in FIG. 2. As can be seen, the machining operation removes excess exterior metal from blank head section 36. In comparison, a contoured interior wall 46 of head section 36, including an interior wall 50 of ring belt subsection 44, corresponds substantially to wall 22 in product member 10.

Ring belt subsection 44 comprises an open end extension 48 remote from crown 42. Extension 48 is internally defined by wall 50 and is externally defined by a frustoconical surface 52 and an axial end surface 54.

Figure 3:
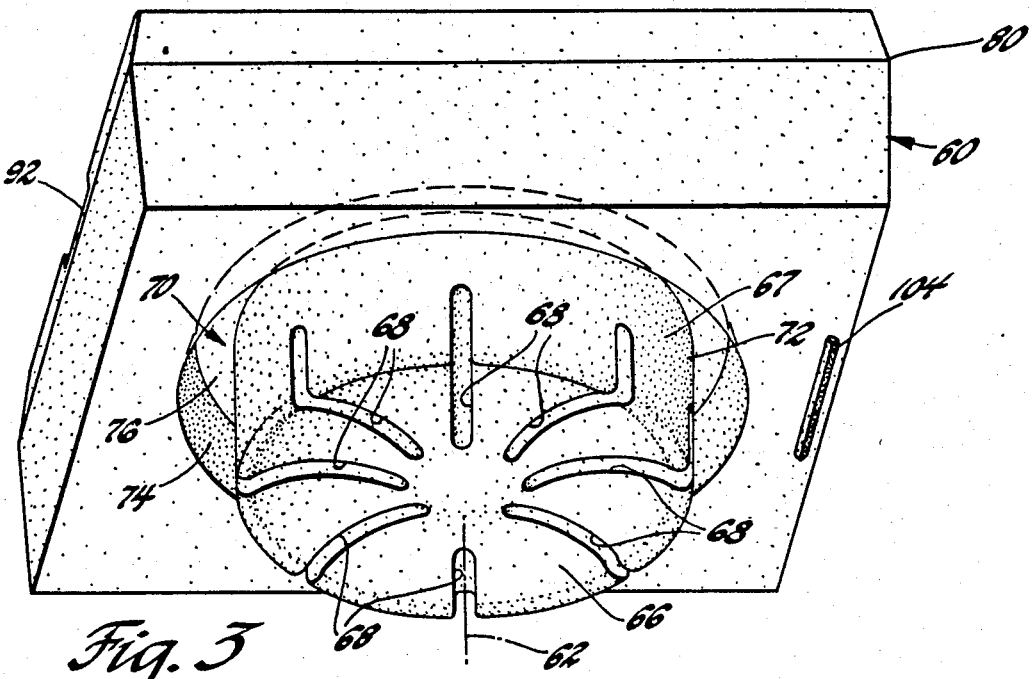
FIG. 3 is a perspective view of a foundry core for casting the blank in FIG. 2 in accordance with this invention.
Figure 4:
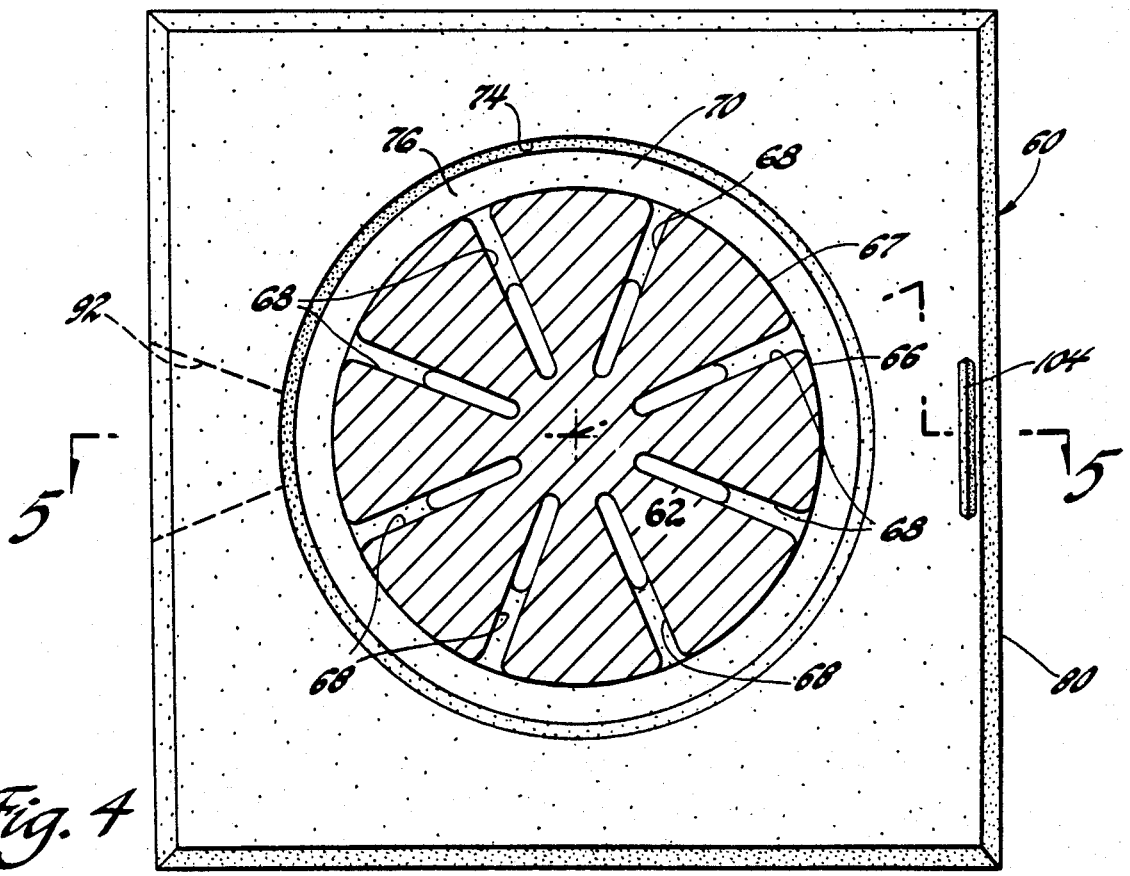
FIG. 4 is a bottom view, partially in section 1 of the core in FIG. 3.
Figure 5:
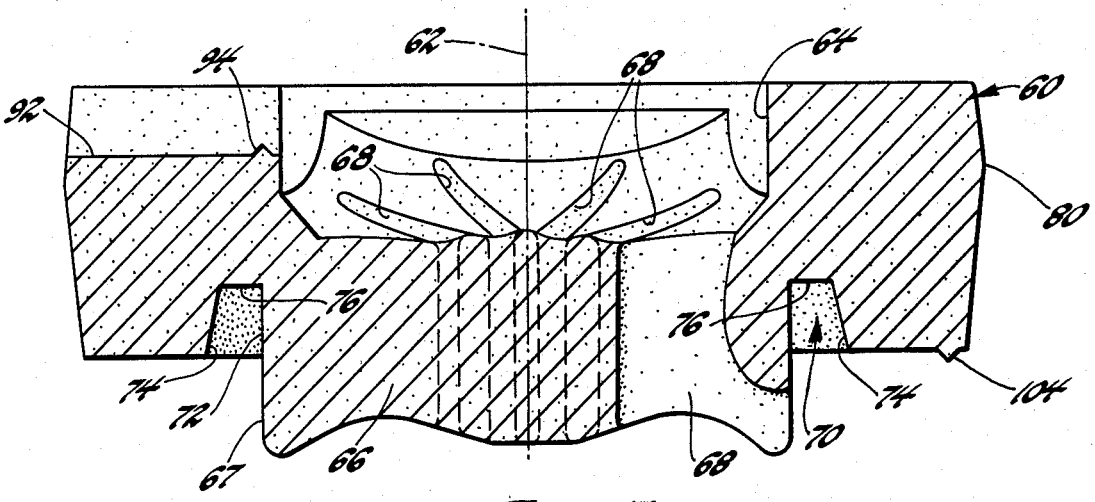
FIG. 5 is a partial cross-sectional view of the core in FIGS. 3 and 4 taken along the line 5—5 in FIG. 4.

Referring now to FIGS. 3 through 5, there is depicted an improved core 60 for casting blank 32 in accordance with this invention. Core 60 has a central axis 62 intended to correspond to axis 34 in blank 32 cast therewith, and thus to axis 12 in product member 10. Core 60 comprises a recessed metal molding surface 64 in FIG. 5 for molding a portion of the skirt connection section 38. Core 60 also includes an axial protrusion 66 for shaping blank head interior 46 and having a circumferential metal molding surface 67 equidistant about axis 62. A plurality of radially disposed passages 68 in core 60 are provided for shaping struts 40. In addition, core 60 comprises an annular groove 70 extending about protrusion 66 for molding blank ring belt extension 48. More particularly, groove 70 is defined by an annular inner surface region 72 of metal molding surface 67. Groove outer surface 74 features a frustoconical shape radially symmetrical about axis 62 and tapering radially outwardly so as to provide a draft suitable for facilitating the release of metal cast within groove 70. Groove 70 also features a radially oriented end surface 76.

Core 60 is formed within a foundry core box comprising halves that cooperate to define a correspondingly shaped cavity. Ridge 80 in FIG. 4 indicates the major (or outer) parting line for the core box halves. One half is shaped for molding core surface 64 and an adjacent portion of passages 68. The second half is shaped for molding protrusion 66, groove 70 and the remainder of passages 68. To form core 60, the core box is filled with foundry core sand containing a resin binder that is isothermally cured to bond the sand into an integral structure. In forming the core, groove 70 is imprinted by an annular boss carried by the second core box half. The boss surface corresponds in shape to groove 70 and accurately determines the contour, including the cross-sectional radii, of surfaces 72 and 74, which surfaces and dimensions are consistently reproduced in cores formed successively in the box. In this manner, it is possible to precisely and reliably form the surfaces 72, 74 and 76 about axis 62.

Figure 6:
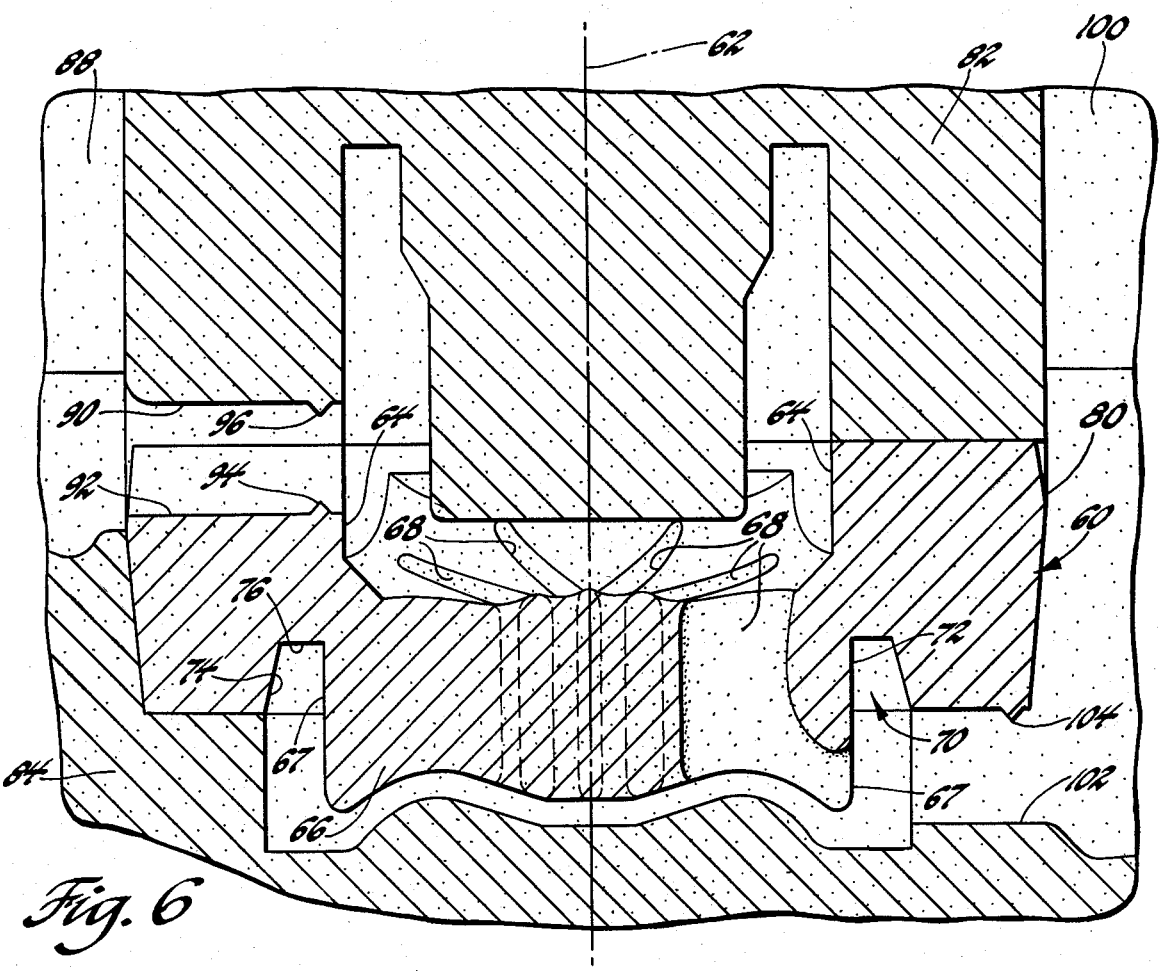
FIG. 6 is a cross-sectional view of a foundry mold comprising the core in FIGS. 3 through 5.

For casting, core 60 is incorporated into a foundry mold comprising a cope 82 and a drag 84 as seen in FIG. 6 that cooperate to define a metal molding cavity for receiving molten iron alloy and forming blank 32. Molten iron alloy is introduced from a first bob 88 through a gate 90. Gate 90 is formed in part by a channel 92 in core 60 adjacent molding surface 64. A sharp ridge 94 in channel 92 and an opposite ridge 96 in cope 82 are provided to form notches in the product casting to facilitate bob removal. Molten metal is also fed into the cavity region that forms blank head section 36 from a second bob 100 through a second gate 102 defined by core 60 in cooperation with a channel in drag 84. Core 60 also features a ridge 104 for forming a notch for bob removal. Although in this example bobs 88 and 100 are shown in a diametrically opposed arrangement about the product cavity for feeding particular regions of the casting cavity, other suitable gating arrangements may be employed for filling the casting cavity, including an arrangement wherein the gates are disposed perpendicularly about axis 62.

The position of core 60 in FIG. 6 determines the orientation of core axis 62, and thus determines the axis 34 of a blank 32 cast therein. Although it is desired that core 60 be accurately positioned with the mold so that molding surfaces of cope 82 and drag 84 also shape metal accurately relative to axis 62, it is a significant feature that core axis 62 is determined independent of cope 82 and drag 84. As a result, desired blank axis 34 is fixed by core 60 despite variance in the positioning of the core with respect to cope 82 and drag 84. Peripheral core surface 67, including groove region 72, shapes ring belt interior wall 50. Further, groove surface regions 74 and 76 shape ring belt extension exterior surface 52 and end surface 54 in blank 32. Thus, the relationship between the groove surface regions and axis 62 is predetermined within the core and in turn accurately establishes the relationship between the ring belt extension surfaces and the central axis 34 in blank 32.

As a result, exterior surface 52 provides a suitable locator region for determining axis 34 in subsequent machining operations. In a turning operation, blank 32 is held by a fixture for turning on a lathe for trimming metal from exterior surfaces. The fixture includes a three jaw chuck that engages extension exterior surface 52 to center the blank. The chuck includes a stop whereagainst is seated extension end surface 54 for axially positioning the blank. Thus the blank is located solely with reference to surfaces molded by core groove 70. The blank is then rotated about the center axis 34. As the blank is turned, the exposed exterior of the ring belt section 44 other than extension 48 is rough machined, as is the crown section 42. In a separate step, the workpiece is gripped about the machined circumference adjacent the crown and rotated, again about axis 34, to trim the skirt connection section 38, along with extension end surface 54. Machined surfaces of the skirt connection are then employed to locate axis 34 once more to rotate the workpiece for finish machining ring belt 18. Thus, the axis of rotation for the machining operation corresponds precisely to blank axis 34 and determines product axis 12.

Therefore, this invention provides a foundry core for use in casting a crosshead piston head member, which core shapes an exterior surface portion of the ring belt section in a predetermined relationship to the center axis of the blank, despite variance in positioning the core within the foundry mold. The core-shaped exterior surface provides a convenient locator for positioning the blank for rotation about the blank center axis for purposes of machining to define the exterior of the product head member. In this manner, the center axis of the product is established during machining. Concurrently, the core also shapes interior surfaces of the head section in the blank in a predetermined relationship relative to the center axis so as to establish a corresponding relationship in the product head member.

Although this invention has been disclosed with respect to casting a crosshead piston head member of a particular design, it may be adapted for use in producing a head member of other suitable design. In general, the core size and shape are determined by the blank required to produce a head member of a desired design. In accordance with this invention, the core wraps around the blank ring belt extension to shape an exterior surface region so that the relationship between the exterior surface region and the core axis is predetermined by the relationship of the corresponding elements of the core. Thus, the core-shaped ring belt exterior surface region provides an accurate reference for machining. Also, in the described embodiment, the head member does not comprise a heat dam of the type formed by a circumferential groove in the ring belt interior wall, which substantially simplifies the core box required to form the core. In the described embodiment, the exterior surface region has a frustoconical shape radially symmetrical about the core axis and features a circular cross section perpendicular to the axis. This facilitates removal of the casting and location of the blank by a machining fixture despite random rotational orientation of the blank. The exterior surface may suitably be nonsymmetrical and may comprise a key or other suitable feature to assist in chucking.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A foundry sand core for incorporation within a foundry sand mold for defining a metal molding cavity sized and shaped for casting metal to form a blank machinable to produce a crosshead piston head member, said blank having sections roughly corresponding to machined elements of the product head member and having a longitudinal axis corresponding to a central axis of the product member, said blank comprising a head section comprising a generally cylindrical ring belt subsection having an open end extension, an axially displaced skirt connection section for attachment to a separately formed skirt member, and a section disposed within ring belt subsection and connecting the head section and the skirt connection section, said foundry sand core being sized and shaped for molding molten metal to form an interior of the ring belt subsection, said core having a central axis corresponding to the blank axis and comprising a first metal molding surface region for shaping an exterior surface of the ring belt extension and a second metal molding surface region for shaping an end surface of the ring belt extension, said first surface region having a predetermined relationship to the core axis for determining in the blank shaped thereby a predetermined relationship between the exterior ring belt extension surface and the blank axis such that the core-shaped blank exterior surface provides a suitable reference for accurately locating the blank relative to the central axis for machining to form the product head member.

2. A foundry sand core for incorporation within a foundry sand mold for defining a metal molding cavity sized and shaped for casting metal to form a blank machinable to produce a crosshead piston head member, said blank having sections roughly corresponding to machined elements of the product head member and having a longitudinal axis corresponding to a central axis of the product member, said blank comprising a head section generally radially symmetrical about the axis and comprising an axial end crown subsection and a dependent, hollow, generally cylindrical ring belt subsection, said ring belt subsection comprising an open end extension remote from the crown subsection, said crown subsection and said ring belt subsection cooperating to define an interior wall within the head section, an axially displaced skirt connection section for attachment to a separately formed skirt member, and a plurality of struts disposed within ring belt subsection and connecting the head section and the skirt connection section, said foundry sand core being sized and shaped for molding molten metal to form the struts and an interior wall of the head section, said core having a central axis corresponding to the blank axis and having an annular groove about the axis for shaping the ring belt extension, said groove being defined by an inner surface region for shaping an interior surface of the ring belt extension and an outer surface region for shaping an exterior surface of the ring belt extension, said outer groove surface being disposed in a predetermined relationship relative to the core axis for duplicating said relationship between the exterior ring belt extension surface and the central axis in the blank, whereby the core-shaped blank exterior surface is suitable for accurately locating the blank relative to the axis for machining to form the product head member.

3. A foundry sand core for incorporation within a foundry sand mold for defining a metal molding cavity sized and shaped for casting iron to form a blank machinable to produce a crosshead piston head member, said blank having sections roughly corresponding to machined elements of the product head member and having a longitudinal axis corresponding to a central axis of the product member, said blank comprising a head section generally radially symmetrical about the axis and comprising an axial end crown subsection and a dependent annular ring belt subsection, said ring belt subsection comprising an open end extension remote from the crown subsection, a skirt connection section axially displaced from the head crown subsection in the direction of the ring belt subsection for attachment to a separately formed skirt member, and a plurality of struts radially disposed within ring belt subsection and connecting the head section and the skirt connection section, said foundry sand core being sized and shaped for molding molten iron to form the struts and an interior wall of the head section, said core being generally radially symmetrical about a center axis corresponding to the blank axis and having an annular groove radially symmetrical about the axis for shaping the ring belt extension, said groove being defined by an inner surface region for shaping a portion of the head section interior wall, a concentric frustoconical outer surface region for shaping an exterior surface of the ring belt extension, and a radially disposed end surface region extending therebetween for shaping an axial end surface of the ring belt extension, said frustoconical surface region being radially symmetrically disposed about the core axis for shaping the exterior ring belt extension surface radially symmetrical about the blank axis and inclined relative to said core axis to provide a reverse draft sufficient to facilitate axial withdrawal of a ring belt extension from the groove, whereby the core-shaped blank exterior surface provides a suitable reference for radially positioning the blank for machining, and further whereby the core-shaped ring belt extension end surface provides a suitable reference for axially positioning the blank for machining.

* * * * *